United States Patent [19]

Westrom et al.

[11] Patent Number: 4,734,670

[45] Date of Patent: Mar. 29, 1988

[54] ELEMENT FOR A CURRENT LIMITING FUSE

[75] Inventors: Arthur C. Westrom, Stone Mountain; Billy R. Livesay, Atlanta; W. Ralph Crooks, Stone Mountain, all of Ga.

[73] Assignee: Kearney, National, Inc., Atlanta, Ga.

[21] Appl. No.: 902,316

[22] Filed: Aug. 29, 1986

[51] Int. Cl.[4] ..... H01H 85/02

[52] U.S. Cl. ..... 337/159; 337/290

[58] Field of Search ..... 337/159, 158, 290, 295; 148/DIG. 55; 420/525

[56] References Cited

U.S. PATENT DOCUMENTS

| | | | |
|---|---|---|---|
| 2,919,984 | 1/1960 | Wasserman et al. | 420/525 |
| 3,124,453 | 3/1964 | Cape et al. | 420/525 |
| 4,374,371 | 2/1983 | Narancic | 337/159 |
| 4,413,246 | 11/1983 | Westrom et al. | 337/159 |

*Primary Examiner*—Harold Broome

*Attorney, Agent, or Firm*—Newton, Hopkins & Ormsby

[57] ABSTRACT

In a current limiting fuse, the combination of a plurality of metallic fuse strips and a packing of silica enveloping said strips, said strips being made of cadmium alloyed with a grain size stabilizing minor amount of a metal selected from the group consisting of zinc and silver.

23 Claims, 13 Drawing Figures

PURE CAMIUM AS RECEIVED

200 X

PURE CADMIUM 150°C 28 DAYS

100 X

CADMIUM 2.5 % ZINC AS RECEIVED

200X

CADMIUM 2.5% ZINC 150°C 28 DAYS

100X

CADMIUM 2% SILVER 150°C 28 DAYS

100X

PURE CADMIUM 17-21X

CADMIUM 2% SILVER

150 X

ELEMENT FOR A CURRENT LIMITING FUSE

BACKGROUND OF THE INVENTION

The invention relates to current limiting fuses of the type using cadmium fuse elements and usable as high voltage general purpose fuses.

The use of cadmium element fuses was proposed at least as early as 1915 as is evidenced by U.S. Pat. No. 1,157,919 of Oct. 26, 1915 which discloses a cadmium element cartridge fuse with a filler of silicic acid. A low voltage cartridge fuse for low current ratings having a single soldered cadmium wire element is disclosed in U.S. Pat. No. 3,529,270 of Sept. 15, 1970.

A cadmium element electrical fuse of the high voltage general purpose current limiting type is disclosed in U.S. Pat. No. 4,374,371 of Feb. 15, 1983, the disclosure of which is incorporated herein by reference. As disclosed, cadmium of purity between 95% and 99.999% is the material of choice for the fuse elements which are preferred to be of helical ribbon form, notched at spaced locations along the length of each ribbon and enclosed within a housing or cartridge substantially filled with spherical grains of high purity, random size quartz sand. A solution to the problem of sublimation of the high purity cadmium is addressed in the subsequent U.S. Pat. No. 4,413,246 of Nov. 1, 1983, the subject matter of which is also incorporated by reference herein. In this latter patent, it is taught to coat the elongate cadmium element with a metal having a melting temperature greater than that of cadmium and which does not significantly diffuse into the bulk of the cadmium element.

The use of cadmium elements as parallel-conducting electrical entities in high voltage general purpose current fuses has been found to eliminate most of the high cost features associated with current limiting fuses employing silver elements, cores, M spots, spark gaps and/or dual elements, in addition to offering superior performance.

BRIEF SUMMARY OF THE INVENTION

The invention which forms the subject matter of this application is directed to improvement in durability of cadmium elements in general purpose high voltage current limiting fuses and more specifically to attainment of fuses of this type which have an extended service life.

During manufacture of the cadmium ribbons preferably employed in the manufacture of fuses according to this invention, the cadmium metal is cast in ingot form, then rolled into foils, slit into thin strips and notched. It has been found that these operations can affect the durability and performance of the manufactured fuse. The fuse before installation may experience a wide range of thermal and mechanical environments which also may affect its durability and performance when in use. For example, repeated mechanical shocks from bouncing around unprotected, in a service truck may occur and substantial diurnal temperature variations or lifetime service variations ranging from −40° C. to 70° C. may also occur. It has been found that these environments may affect the durability and performance when the fuse is in use. Thus, it has been found that care should be taken to avoid deleterious effects due to the above factors, to the extent that this is practical and possible.

Nevertheless, once the fuse is installed, the cadmium conductors are generally subjected cyclically to extremely high current density for an extended period of time (usually all during a day) during which time their temperatures are elevated well above ambient temperature, followed by a cooling period (usually overnight). This service requirment of thermal cycling and concomitant mechanical cycling as well as the thermal/mechanical cycling due to a current flow and fluctuations in current demand while the fuse is in use must be accommodated if the fuse is to perform reliably over an extended and acceptable service life.

It has been found, according to this invention, that durability and performance reliability may be extended in fuses of the type to which the invention is directed if the cadmium metal of which the fuse conductors are made is "doped" or alloyed with a metal in minor amount effective to influence and stabilize the grain structure of the conductive elements without significantly altering the desirable electrical and physical properties of the cadmium metal.

It has been found that such minor amount of alloying metal ameliorates the effects of all of the above factors and hardens as well as strengthens the fuse elements, all without deleteriously affecting the desirable electrical properties of high purity cadmium, or its physical properties, particularly its tensile strength and fatigue strength.

It has been found that the minor amount of the alloying metal must be controlled so that an intermetallic phase is avoided, while attaining a phase in which the "dopant" metal forms sites which influence the alloy to have small grain size. It has been found that if these criteria are followed, the grain size of the alloy will be stabilized to avoid the recrystallization of the alloy at the temperatures to which it is subjected in normal use into large crystals, particularly at the notches, which create the potential for premature physical failure of the conductor.

The alloying metals which are preferred are silver and zinc and the preferred minor amounts thereof are in the order of 1.5–2.5%.

BRIEF DESCRIPTION OF THE DRAWING FIGURES

DETAILED DESCRIPTION OF THE INVENTION

Figure 1:
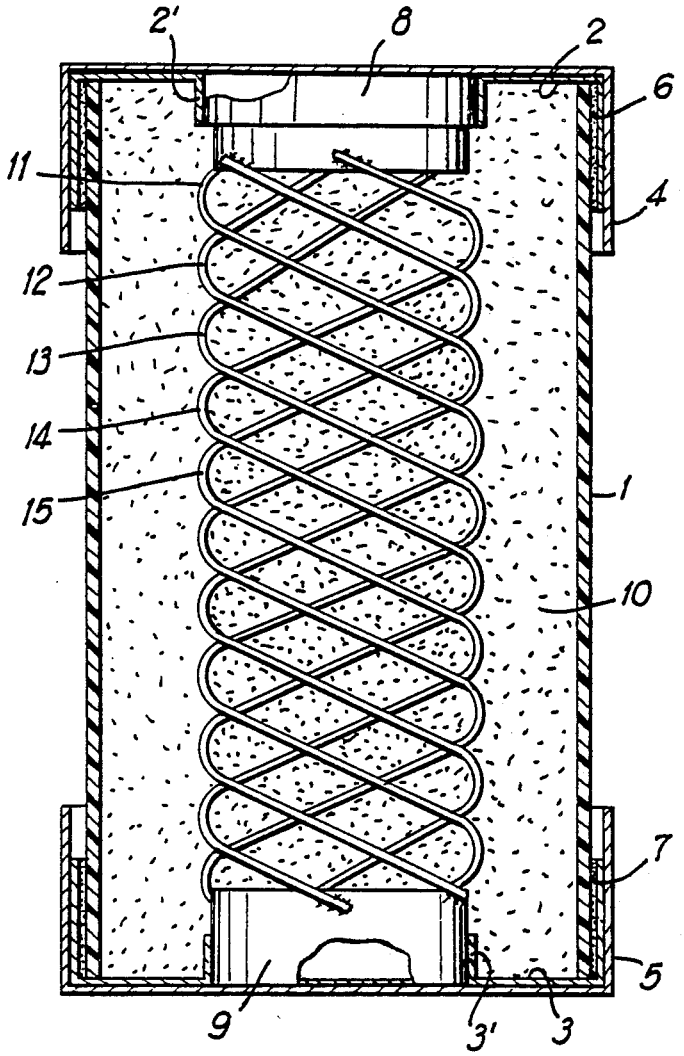
FIG. 1 is a longitudinal section taken through a typical fuse according to this invention.

With reference to FIG. 1, the tubular housing 1 is formed of suitable insulating material and is provided with end caps 2 and 3 disposed at the opposite ends of the housing 1 and secured thereto by suitable adhesive means 6 and 7. Each end cap 2 and 3 is formed of a suitable conductive material and is centrally apertured and flanged as at 2′ and 3′. A terminal sleeve 8 is received in the flange 2′ and a terminal cap 9 is received in the flange 3′. The sleeve 8 and cap 9 provide the terminal ends of a plurality of helical fusible elements 11–15, to which they are electrically connected in the well known manner to form a subassembly which is assembled into the housing 1 with the end cap 3 in place. The terminal cap 5 is then applied after the terminal caps has been suitably electrically connected to the flange 3′, and then the end cap 2 is fitted with the housing 1 and the sleeve 8 and electrically connected thereto. This assembly is then filled with the high purity quartz sand or silica 10 though the opening provided by the sleeve 8 and, finally, the terminal cap 4 is fitted and secured in place. The outer or terminal caps 4 and 5 are secured over the end caps 2 and 3 through a press fit therewith to assure a good electrical connection in each case.

Figure 2:
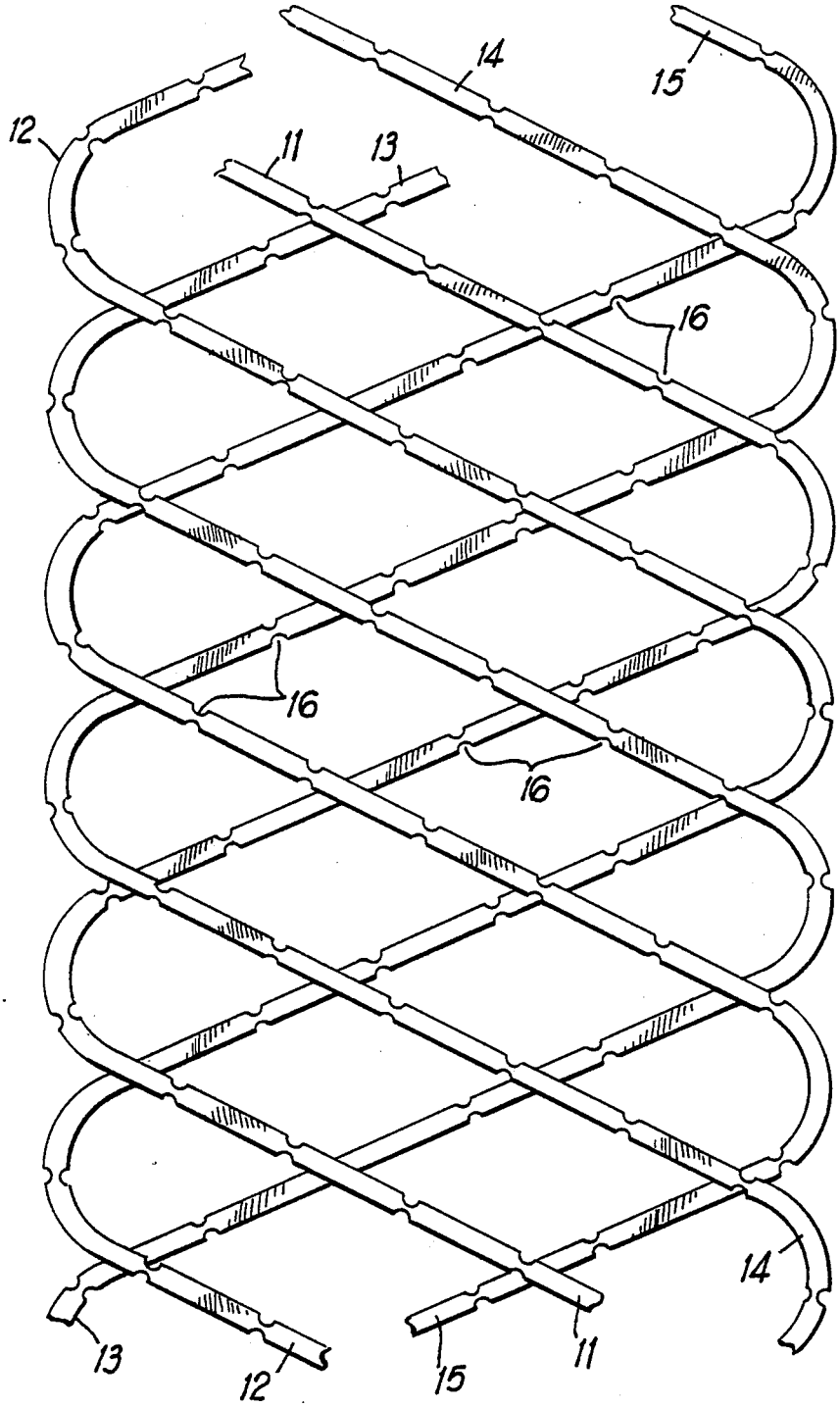
FIG. 2 is an enlarged view depicting the details of construction of the fusible elements shown in FIG. 1.

As will be seen in FIG. 2, the fusible elements 11–15 are provided with notches 16 disposed along their lengths and in the preferred form of the invention, these elements are in the form of ribbons as illustrated in FIG. 2. It will be understood that there may be a greater or lesser number of fusible elements than illustrated.

As noted hereinbefore, by minor amount of the alloying material is meant an amount thereof which does not produce an intermetallic phase alloy but wherein the phase attained is one in which the "dopant" metal serves to stabilize grain structure at elevated temperatures and which may also serve as a precipitant creating nucleation sites further promoting the stabilization of small grain size in comparison with the grain size otherwise characteristic of the high purity cadmium.

Figure 3:
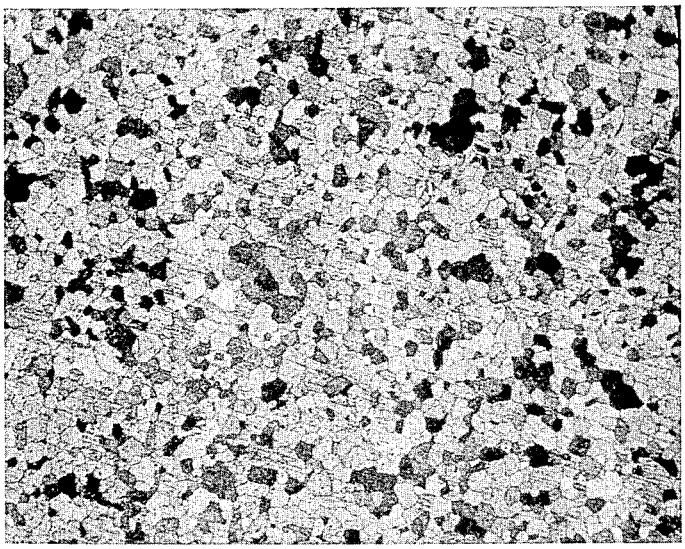
FIG. 3 is a photomicrograph, at 200× magnification, of a fusible element according to the prior art, employing high purity cadmium, as received, prior to testing.
Figure 4:
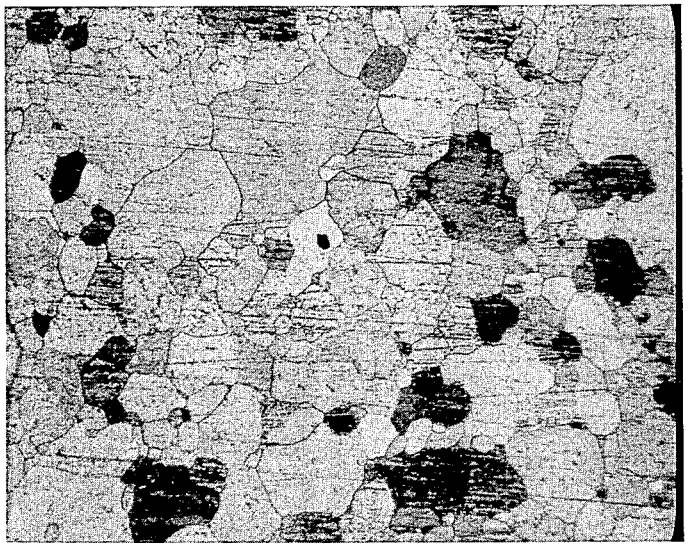
FIG. 4 is a photomicrograph, at 100× magnification, of a fusible element according to the prior art, employing high purity cadmium, having been subjected to an elevated temperature of 150° C. for 28 days.
Figure 5:
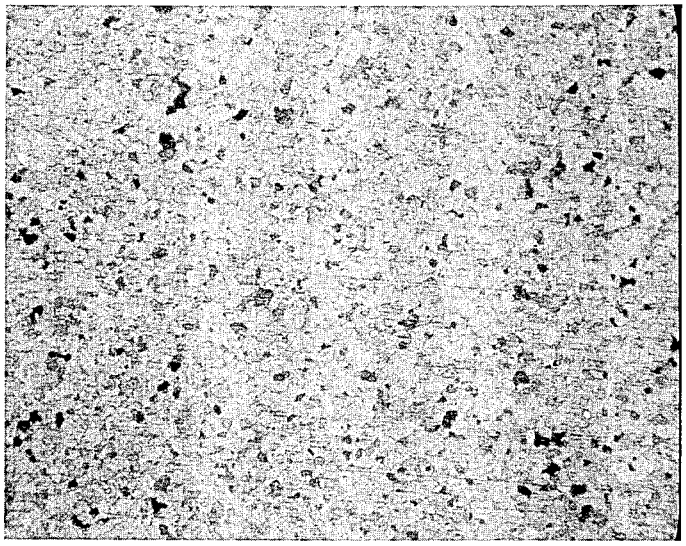
FIG. 5 is a photomicrograph, at 200× magnification, of a fusible element according to this invention, as received, prior to testing.
Figure 6:
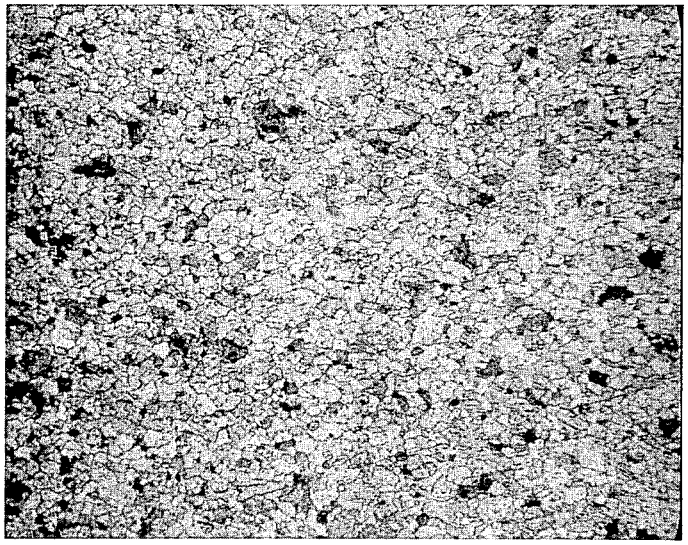
FIG. 6 is a photomicrograph, at 100× magnification the fusible element according to this invention having been subjected to an elevated temperature of 150° C. for 28 days.
Figure 7:
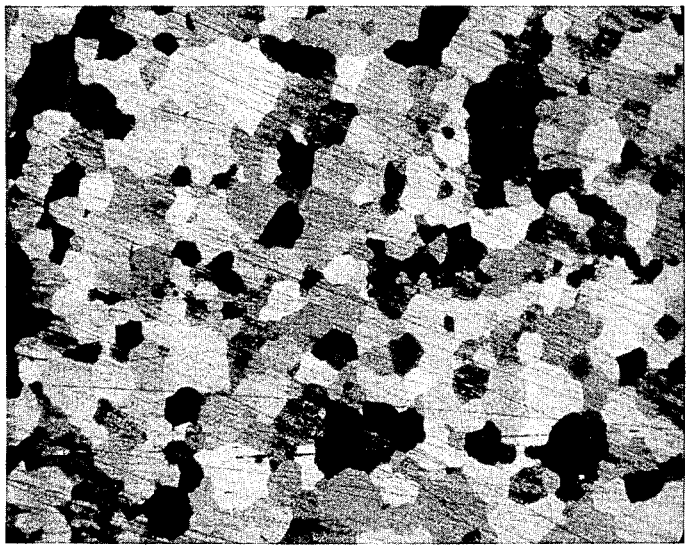
FIG. 7 is a photomicrograph, at 100× magnification, of another fusible element according to this invention having also been subjected to an elevated temperature of 150° C. for 28 days.

To illustrate this point, reference is had at this time to FIGS. 3–7. FIG. 3 is a photomicrograph of a high purity cadmium fusible ribbon as received for implementation in a current limiting fuse. FIG. 4 is a photomicrograph of a high purity cadmium fusible element which has been subjected to an elevated temperature of 150° C. for 28 days. FIG. 5 is a photomicrograph of a fusible element similar to that of FIG. 3 but which is formed from an alloy which is 2.5% zinc and the remainder substantially pure cadmium as received for implementation in a current limiting fuse. FIG. 6 is a photomicrograph of a fusible element as in FIG. 5 and which has likewise been subjected to a temperature regime of 150° C. for 28 days. FIG. 7 is a photomicrograph of a fusible element formed of 2% silver and the remainder substantially pure cadmium and which has also been subjected to a temperature of 150° C. for 28 days. The magnification in FIGS. 3 and 5 of elements, as received, is 200× or twice that of FIGS. 4, 6, and 7.

As seen in FIGS. 3 and 4, there is a considerable amount of recrystallization and grain growth in the substantially pure cadmium fusible element at elevated temperatures. Such changes occur to a lesser degree in pure cadmium at ambient temperatures. On the other hand, very little change occurred in the microstructure of the "doped" element, FIGS. 5 and 6. (FIG. 5 is at twice the magnification of FIG. 6.) FIG. 7 shows that an element "doped" with 2% silver likewise retains a uniform and stabilized crystalline structure at elevated temperatures as compared to pure cadmium, FIG. 4.

In pure or substantially pure metals of low melting point temperatures, when subjected to a temperature of more than about 0.4 times the melting point temperature, based upon the Kelvin scale, recrystallization and grain size growth may be expected. The melting point temperature of cadmium is about 321° C. or 594° K. Thus, room temperature of 20° C. or 293° K. represents about 0.5 times the melting point temperature of cadmium, based upon the Kelvin scale. In the normal course of use, the operating temperature of fuses according to this invention may be expected to be in the order of 100° C. The temperature of 150° C. to which the samples whose photomicrograph is depicted in FIGS. 6 and 7 probably represents about the lower limit of this "dopant" or alloying metal for cadmium insofar as this invention is concerned.

As will be seen from Table 1 here following, an increase to 2.5% zinc, which probably represents about the upper limit of zinc insofar as this invention is concerned, results in the desired grain size control and also attains an increase in the important physical property of tensile strength. The results noted in Table 1 report the mean tensile strength in a number of samples for each of the tabulated tests.

TABLE 1*

| Material and conditions | Mean tensile strength, grams |
|---|---|
| 1. Cd ribbon, as received. | 582 |
| 2. Same as 1 but annealed for 96 hours at 150° C. | 441 |
| 3. Same as 1, in a test fuse. | 342 |
| 4. 2% Ag, remainder essentially Cd, as received. | 988 |
| 6. Same as 4 but conditions of 2. | 639 |
| 7. Same as 4 but conditions of 3. | 755 |
| 8. 1% Ag, remainder essentially Cd, as received. | 916 |
| 9. Same as 8 but conditions of 2. | 566 |
| 10. 2.5% Zn, remainder essentially Cd, as received. | 790 |
| 12. Same as 10 but conditions of 2. | 835 |
| 13. Same as 10 but conditions of 3. | 685 |
| 14. 1.5% Zn, remainder essentially Cd, as received. | 732 |
| 15. Same as 14 but conditions of 2. | 790 |

*Each sample ribbon was 0.050" wide and 0.0075" thick.

In Table 1, the tensile strengths of the various ribbons, as received, clearly shows that each of 4, 8, 10 and 14, the tensile strength was increased in each case in comparison with 1. The results tabulated for 3, after actual use in a test fuse for substantially pure cadmium, when compared with the results tabulated at 7 and 13 also clearly show that for substantially pure cadmium, tensile strength was degraded by about 41%, with 2% Ag by about 24% and with 2.5% Zn by about 13%, with the alloyed ribbons in all such cases displaying tensile strengths at least twice that of 3.

The influence and control of grain size and the stabilization thereof achieved by this invention is clearly evident from the increases in tensile strength noted in Table 1. At the same time, the electrical performance of fuses according to this invention is not degraded in comparison with like fuses made from ribbons of substantially pure cadmium. Fuses in accord with this invention may be made with ratings from 6 A through 400 A and from 8.3 kV through 38 kV.

Elements made in accord with applicants' invention herein were further tested to determine their ability to withstand severe current cycling. Repeated cycling can eventually cause element fracture due to fatigue. Selected elements were subjected to a cycling duty consisting of four on and four off periods, each of three hours, per day. The testing was run continuously with each fuse being monitored for damage by accurate resistance measurement towards the end of the 6 A.M. to 9 A.M. off period. The period of three hours on or off was chosen as being sufficient to allow a steady state temperature condition to be reached during each period.

Sample fuses were connected in series in a test circuit so that each experienced the same values of current, 40 amps, and duration. The circuit was loaded with additional resistance sufficient to swamp the effect of the increased resistance of the fuses when hot. Each fuse had six elements of identical composition and cross section. Damage in the form of an open circuited element in a sample fuse was detected by a 20% (6/5) increase in resistance. The results of the load cycling tests are found in Table 2 below.

TABLE 2

| Fuse Type | Date Started | Date Finished | No. of Cycles to Fracture |
|---|---|---|---|
| B | 12-20-85 | 02-25-86 | 270 |
| B | 03-07-86 | 05-27-86 | 323 |
| C | 04-25-86 | 05-19-86 | 95 |
| D | 12-20-85 | 01-22-86 | 131 |
| D | 02-12-86 | 03-19-86 | 139 |
| E | 12-20-85 | 01-06-86 | 70 |
| E | 03-07-86 | 03-27-86 | 79 |

The test samples were identified as follows.

| Fuse Type | Description |
|---|---|
| B | Element material: 98% Cd/2% Ag |
| C | Element material: 98.5% Cd/1.5% Zn |
| D | Element material: 97.5% Cd/2.5% Zn |
| E | Element material: 99.9% Cd |

The load cycling tests demonstrate the superiority of a "doped" cadmium element over an essentially pure cadmium element. It is seen from Table 2 that a "doped" fuse element maintains its mechanical integrity when subjected to severe load cycling much longer than a pure cadmium fuse element. Over a 400% improvement in the durability and service life of a current limiting fuse can be attained through use of a "doped" element of the present invention.

Figure 8:
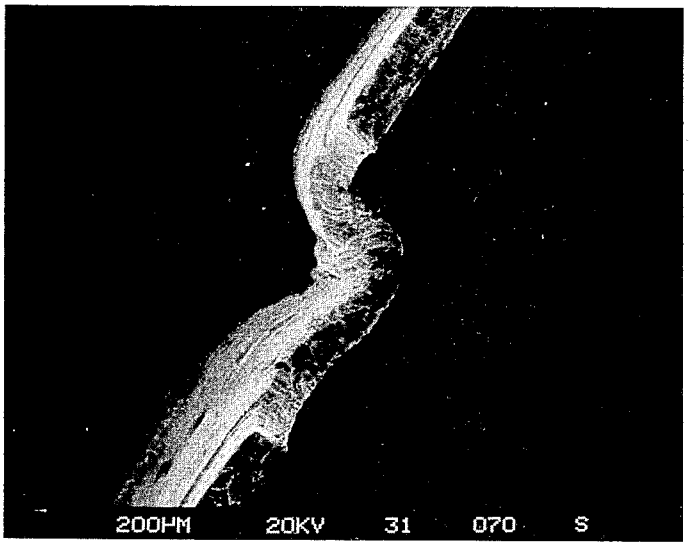
FIG. 8 is a photomicrograph showing a notched section of a pure cadmium element after having been subjected to load cycling, but prior to fracture.
Figure 9:
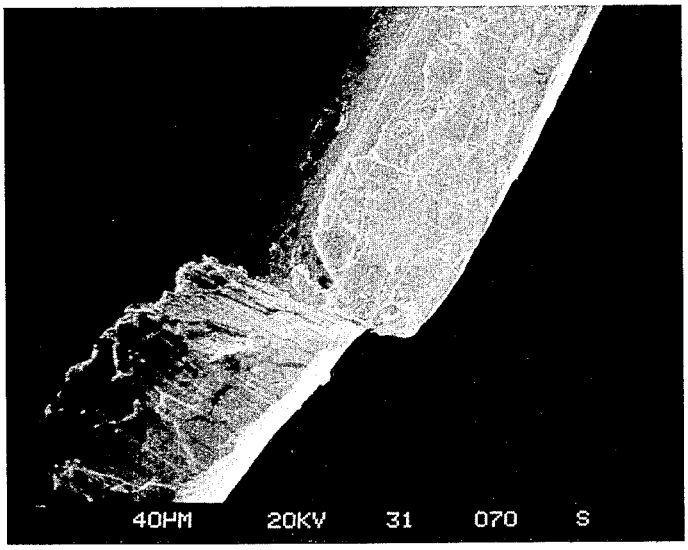
FIG. 9 is a photomicrograph at the notch of a prior art pure cadmium fuse element wherein grain boundary slippage has occurred.

It was observed during the load cycling tests that, after being subjected to a certain amount of load cycling the pure cadmium fuse elements would ultimately fracture with the fracture always occurring at a notch 16 in the element. FIG. 8 is a photomicrograph showing a notched section of a pure cadmium element after the element has been subjected to load cycling, but prior to fracture, wherein a kink has developed at the notch. Such kinks were commonly observed at the notches of pure cadmium fuse elements subjected to load cycling. This kinking at the notches combined with the tendency of pure cadmium to anneal or recrystalize at temperatures as low as room temperature, appears to cause slippage between the grain boundaries at the notches, FIG. 9, and ultimately fracture of the pure cadmium element.

Figure 11:
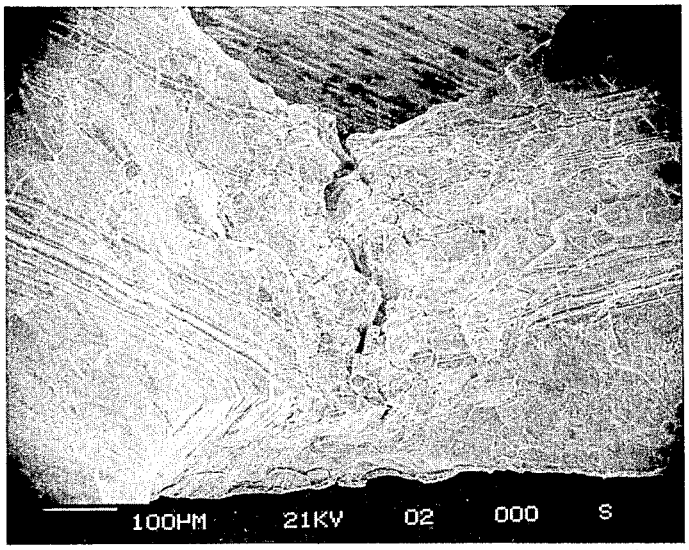
FIG. 11 is a photomicrograph of a notched section of a fusible element of the present invention alloyed with silver which element has been subjected to load cycling.
Figure 10:
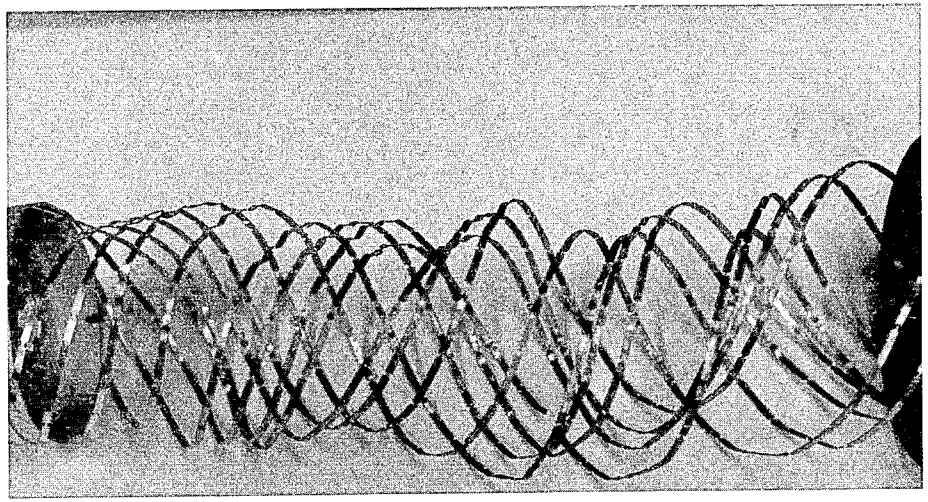
FIG. 10 is a photograph of fusible elements of the present invention from a current limiting fuse which had been subjected to load cycling.

On the other hand, it was observed that the "doped" fuse elements of the present invention which had been subjected to load cycling would set in a sinusoidal-like configuration where the nodes or bends were not restricted to the notches in the element as in the pure cadmium elements. Instead, more gradual bending occurred along the length of the element, irrespective of the notches, as shown in FIG. 10 which is a photograph of cadmium elements alloyed with 2% silver of a current limiting fuse which had been subjected to load cycling. As seen in FIG. 10, the "doping" of a cadmium element with a minor amount of a second metal in accordance with the present invention was effective to allow for substantially uniform displacement of the metal composition of the element when subjected to load cycling. The alloyed elements would thus fracture as a result of cracking, FIG. 11, as opposed to cracking accelerated by early grain boundary slippage in the pure cadmium element.

Separately, samples of uniform length of portions of fuse elements were tested to determine the effect of "doping" the fuse elements on the rate of creep and creep elongation as compared to a pure cadmium fuse element. The examples were first annealed by placement in an oven at 150° C. for 23 hours to similulate the effect on the sample of a fuse element having been subjected to about three power load cycles in the field. After having cooled to ambient temperature, the samples were subjected to a creep force of 250 grams, about ½ the breaking force of pure cadmium, and creep elongation monitored. All samples were treated with sulfuric acid about 2–3 hours into the test to be sure that test to be sure that formation of an oxide coating on the surface of the sample was not affecting the test results. The acid treatment caused no change in the creep rate for any of the samples.

Figure 12:
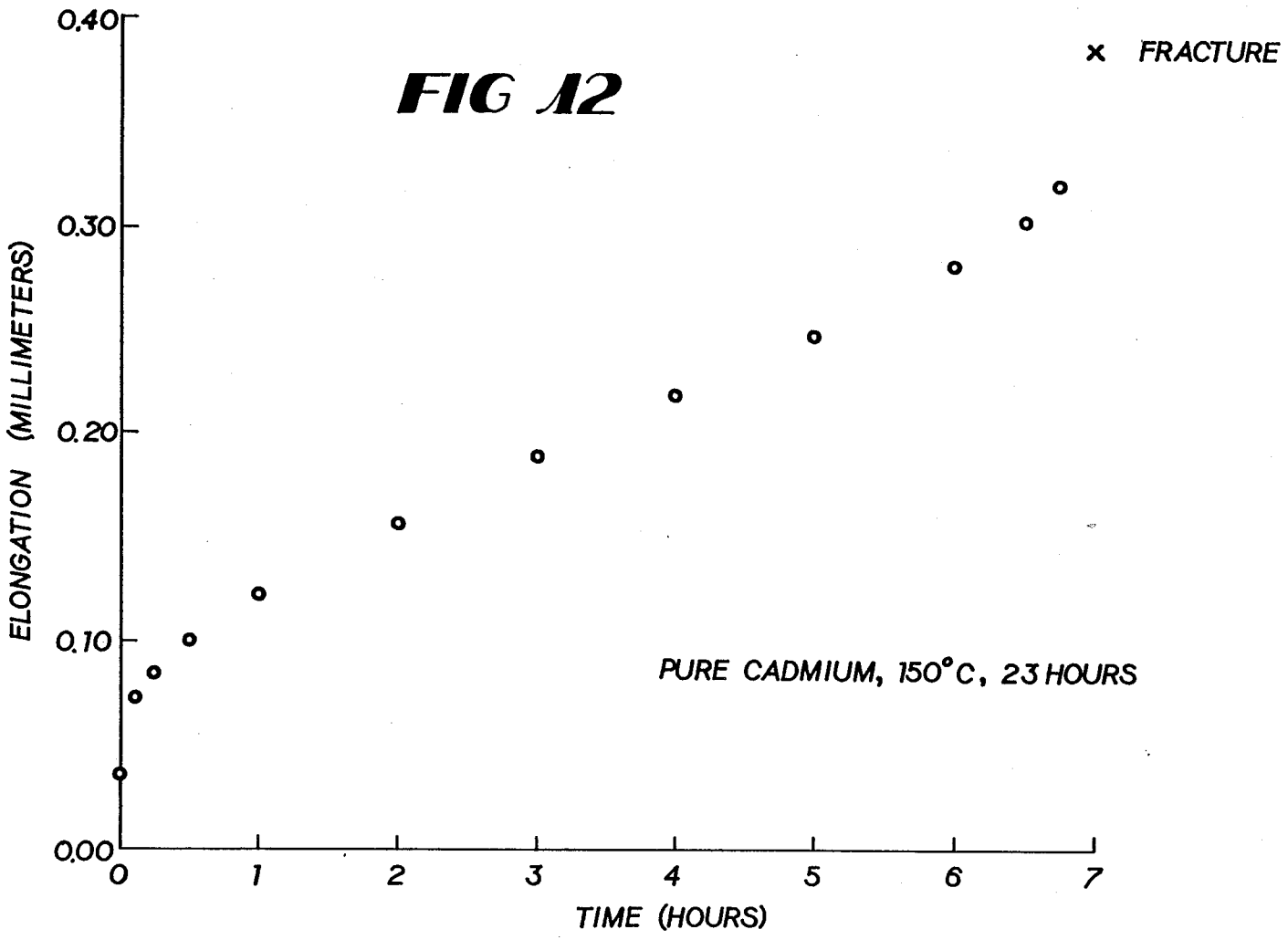
FIG. 12 is a chart showing the results of a creep test on a fuse element, sample of pure cadmium.

FIG. 12 is a chart showing the results of the creep test on a pure cadmium sample. Initial elongation was 0.036 mm. The sample finally fractured after just over seven hours having elongated 0.384 mm. just prior to fracture. The rate of creep of the sample was 0.029 mm/hr.

Figure 13:
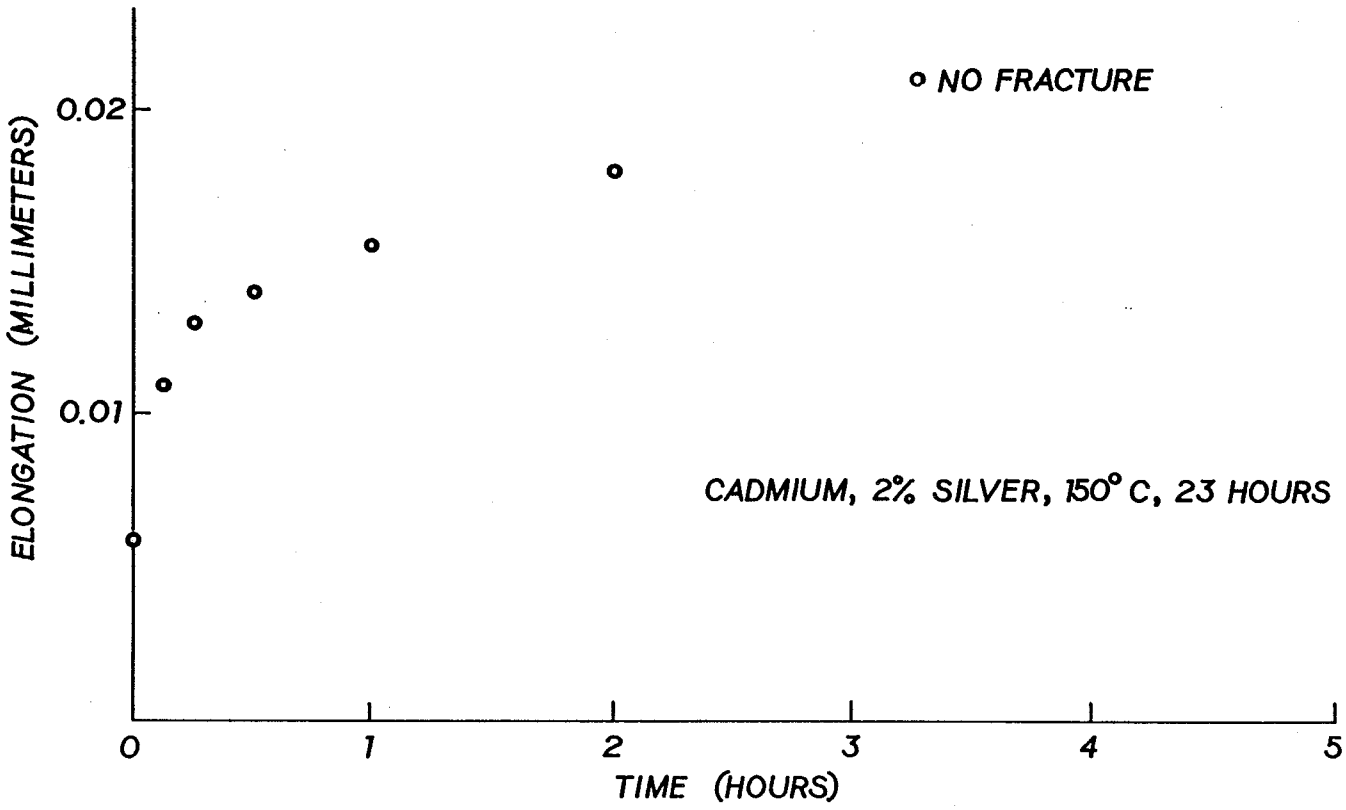
FIG. 13 is a chart showing the results of a creep test on a fuse element sample of the present invention.

FIG. 13 is a chart showing the results of the creep test on a cadmium sample alloyed with 2% silver. Initial elongation was 0.006 mm. The sample elongated to about 0.02 mm. after 3 hours. The test continued for several more hours and was finally ceased without fracture. The rate of creep was 0.0025 mm/hr. Thus, the initial elongation, total elongation and creep rate were all strikingly less than for the pure cadmium sample.

What is claimed is:

1. A new alloy for use as a fuse element in a current limiting fuse application, which comprises cadmium and a minor amount of a metal effective to stabilize grain structure at elevated temperatures of normal usage of the fuse element as compared with fuse elements made of substantially pure cadmium, said minor amount of a metal being selected from the group consisting of zinc and silver and being present in amount of up to about 2.5% by weight.

2. A current limiting fuse comprising a cartridge having electrically conductive opposite end portions and defining a fuse chamber, a plurality of metallic fuse strips extending in non-linear fashion between said opposite end portions and electrically joined thereto, and a packing of silica within said chamber, said fuse strips being made of cadmium having an effective minor amount of a metal alloyed therein which stabilizes grain size at elevated temperatures of normal usage of the fuse as compared with fuse strips made of substantially pure cadmium.

3. A current limiting fuse as defined in claim 2 wherein said minor amount of a metal is zinc.

4. A current limiting fuse as defined in claim 2 wherein said minor amount of a metal is silver.

5. In a current limiting fuse, the combination of a plurality of metallic fuse strips and a packing of silica enveloping said strips, said strips being made of cadmium alloyed with a grain size stabilizing minor amount of a metal selected from the group consisting of zinc and silver.

6. A new alloy for use as a fuse element in a current limiting fuse application, which comprises cadmium and a minor amount of a metal selected from the group consisting of zinc and silver, said minor amount of a metal being present in amount of up to about 2.5% by weight.

7. A current limiting fuse comprising a cartidge having electrically conductive opposite end portions and defining a fuse chamer, a plurality of metallic fuse strips extending in non-linear fashion between said opposite end portions and electrically joined thereto, and a packing of silica within said chamber, said fuse strips being made of an electrically conductive first metal having an effective minor amount of a second metal alloyed therein so that the element will undergo substantially uniform displacement of the microstructure of the element when subjected to load cycling.

8. A current limiting fuse as defined in claim 7 wherein said electrically conductive first metal is cadmium.

9. A current limiting fuse as defined in claim 8 wherein said second metal is zinc.

10. A current limiting fuse as defined in claim 9 wherein said second metal is silver.

11. A new alloy for use as a fuse element in a current limiting fuse application, which comprises cadmium and a minor amount of a metal effective to stabilize grain structure at elevated temperatures of normal usage of the fuse element as compared with fuse elements made of substantially pure cadmium, wherein the minor amount of a metal is further effective to accommodate substantially uniform displacement of the microstructure of the element when subjected to load cycling.

12. A new alloy as defined in claim 11 wherein the minor amount of a metal is zinc.

13. A new alloy as defined in claim 11 wherein the minor amount of a metal is silver.

14. A current limiting fuse comprising a cartridge having electrically conductive opposite end portions and defining a fuse chamber, a metallic fuse strip extending between said opposite end portions and electrically joined thereto, and a packing of silica within said chamber, said fuse strip being made of an electrically conductive first metal having an effective minor amount of a second metal alloyed therein effective to reduce the rate of creep in the element due to forces of tension or compression or both when the element is subjected to load cycling as compared with fuse elements made of substantially pure cadmium.

15. A new alloy as defined in claim 14 wherein said electrically conductive first metal is cadmium.

16. A new alloy as defined in claim 14 wherein the rate of creep is reduced by about an order of magnitude or greater.

17. A new alloy as defined in claim 14 wherein the second metal is zinc.

18. A new alloy as defined in claim 18 wherein the second metal is silver.

19. A current limiting fuse comprising a cartridge having electrically conductive opposite end portions and defining a fuse chamber, a metallic fuse strip extending between said opposite end portions and electrically joined thereto, and a packing of silica within said chamber, said fuse strip being made of cadmium having an effective minor amount of a metal alloyed therein which stabilizes grain size at elevated temperatures of normal usage of the fuse as compared with a fuse strip made of substantially pure cadmium.

20. A current limiting fuse as defined in claim 19, wherein said minor amount of a metal is selected from the group consisting of zinc and silver or both.

21. In a current limiting fuse, the combination of a metallic fuse strip and a packing of silica enveloping said strip, said strip being made of cadmium alloyed with a grain size stabilizing minor amount of a metal selected from the group consisting of zinc and silver.

22. A current limiting fuse comprising a cartridge having electrically conductive opposite end portions and defining a fuse chamber, a metallic fuse strip extending between said opposite end portions and electrically joined thereto, and a packing of silica within said chamber, said fuse strip being made of an electrically conductive first metal having an effective minor amount of a second metal alloyed therein so that the element will undergo substantially uniform displacement of the microstructure of the element when subjected to load cycling.

23. A current limiting fuse as defined in claim 22, wherein said minor amount of a metal is selected from the group consisting of zinc and silver or both.

* * * * *